US007229296B2

(12) United States Patent
Pillet

(10) Patent No.: US 7,229,296 B2
(45) Date of Patent: Jun. 12, 2007

(54) CONTACT DEVICE FOR IMPROVING LIFETIME OF ELECTRICAL CONNECTIONS

(75) Inventor: Michel Pillet, Saint Cézaire sur Siagne (FR)

(73) Assignee: AMC S.a.r.l., Cannes (FR)

( * ) Notice: Subject to any disclaimer, the term of this patent is extended or adjusted under 35 U.S.C. 154(b) by 0 days.

(21) Appl. No.: 10/535,244

(22) PCT Filed: Nov. 20, 2003

(86) PCT No.: PCT/FR03/03440

§ 371 (c)(1),
(2), (4) Date: May 18, 2005

(87) PCT Pub. No.: WO2004/049515

PCT Pub. Date: Jun. 10, 2004

(65) Prior Publication Data

US 2006/0051990 A1 Mar. 9, 2006

(30) Foreign Application Priority Data

Nov. 20, 2002 (FR) ..... 02 14528

(51) Int. Cl.
*H01R 4/58* (2006.01)

(52) U.S. Cl. ..... 439/86; 439/90; 439/927

(58) Field of Classification Search ..... 439/86, 439/87, 88, 90, 927; 428/221, 304.4, 319.1; 361/395, 392
See application file for complete search history.

(56) References Cited

U.S. PATENT DOCUMENTS

| | | | | |
|---|---|---|---|---|
| 3,539,973 | A * | 11/1970 | Wright et al. | 439/90 |
| 4,923,739 | A * | 5/1990 | Jin et al. | 428/221 |
| 5,153,818 | A * | 10/1992 | Mukougawa et al. | 361/737 |
| 5,360,355 | A | 11/1994 | Ehrler et al. | 439/816 |
| 5,857,858 | A * | 1/1999 | Gorowitz et al. | 439/86 |
| 6,114,645 | A * | 9/2000 | Burgess | 200/512 |
| 6,309,742 | B1 * | 10/2001 | Clupper et al. | 428/304.4 |

FOREIGN PATENT DOCUMENTS

| | | |
|---|---|---|
| JP | 53-80589 | 7/1978 |
| WO | WO 02/059396 | 8/2002 |

* cited by examiner

*Primary Examiner*—Hien Vu
(74) *Attorney, Agent, or Firm*—James C. Lydon

(57) ABSTRACT

A contact device for enhancing the conductance of an electrical connection which includes two conductors (21 and 23) in contact with each other essentially including an interposed conductive element arranged between the two contact surfaces (22 and 24) of the two conductors (21 and 23) of the connection. The interposed conductive element is made of electrically conductive foam (10) which includes one or more materials with high porosity and deformability so as to reduce the electrical resistance of the connection.

5 Claims, 2 Drawing Sheets

CONTACT DEVICE FOR IMPROVING LIFETIME OF ELECTRICAL CONNECTIONS

Figure 1A:
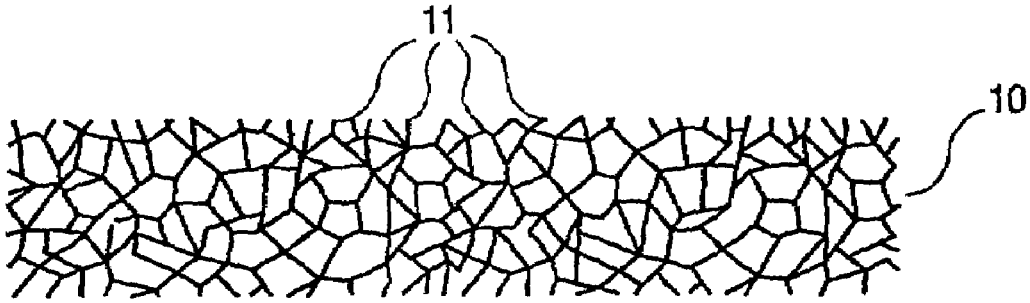

This invention concerns devices for improving and increasing the conductance of electrical connections and relates in particular to a contact device to improve the service life of electrical connections.

In the field of power electrical engineering, the electrical connections of electrolytic cells or steel plant furnaces are subjected to high-intensity currents (1>1,000 A) and high temperatures. This results in significant electrical losses which could reach several kW per connection and the resulting loss of output is a major problem. The degradation of these connections is irreversible. Furthermore, the degradation of the contact surfaces induces variations in the density of the current through this surface. Electrical losses ensue owing to the joule effect and even an increase in temperatures which accelerates the degradation of the connections and the conductors, and may even cause them to melt.

Maintenance of the connections requires that they be disassembled so that the areas of contact can be resurfaced. Rotary disc grinders are generally used to perform these resurfacing operations. They wear down the entire flatness of the contact surfaces, which limits the areas and the points of contact. As the areas of contact are small, the connections are subjected to electrical stresses that are concentrated in these areas and causes them to degrade even faster.

In order to obtain the original connection contact surfaces, the connections must be completely disassembled so that the contact surfaces can be re-machined. However, this operation is rather tedious and expensive.

This is why the main purpose of the invention is to supply a contact device for electrical connections in order to improve the electrical conductance of these connections and to slow down the degradation of the contact surfaces.

Another purpose of the invention is to provide a contact device to improve electrical connections in order to increase the electrical performance characteristics of these connections when they are in an advance state of degradation.

A third purpose of the invention is to provide a contact device designed to improve electrical connections subject to high-intensity currents above 1,000 A in order to enhance the electrical performance characteristics of these connections.

The object of the invention is thus a contact device for improving the conductance of an electrical connection consisting of two conductors in contact with one another, essentially including a conductive insert placed between the two contact surfaces of the two conductors of the connection. According to the main characteristic of the invention, the conductive insert consists of an electrically conductive foam made of one or more materials, with high deformability and porosity in order to reduce the resistance of the connection.

Figure 1B:
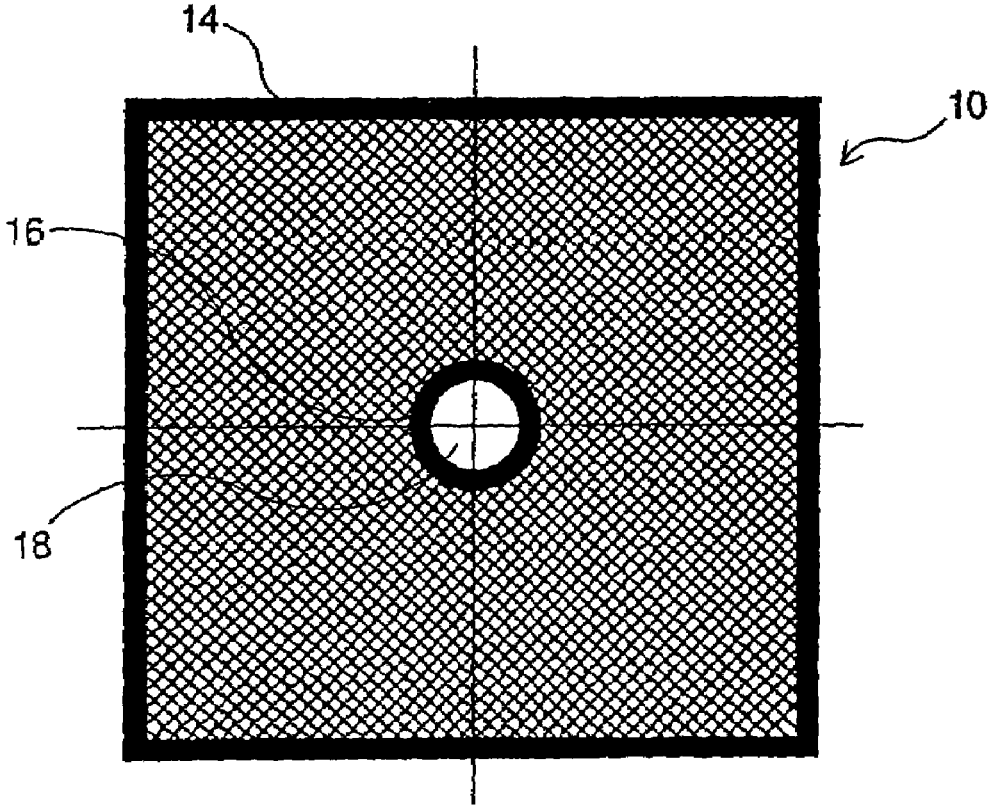
Figure 2A:
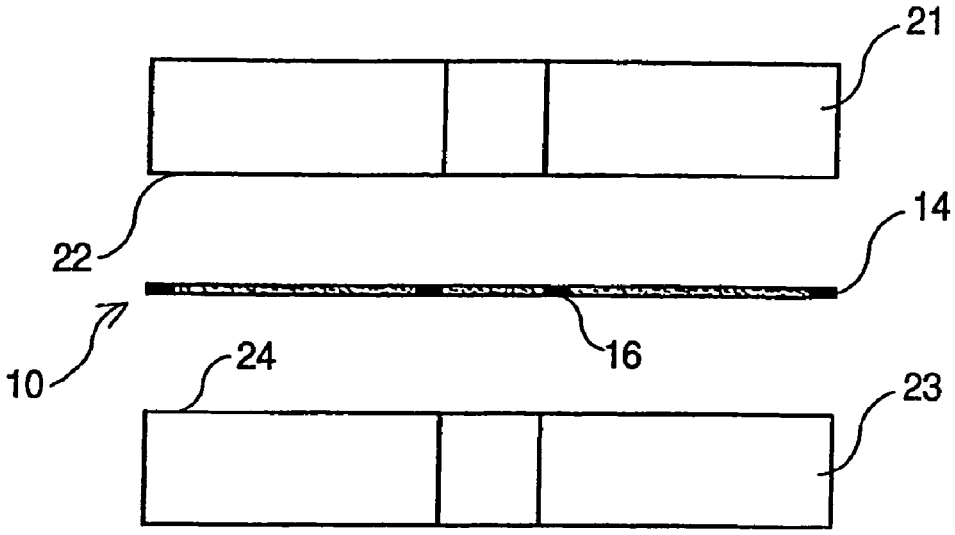
Figure 2B:
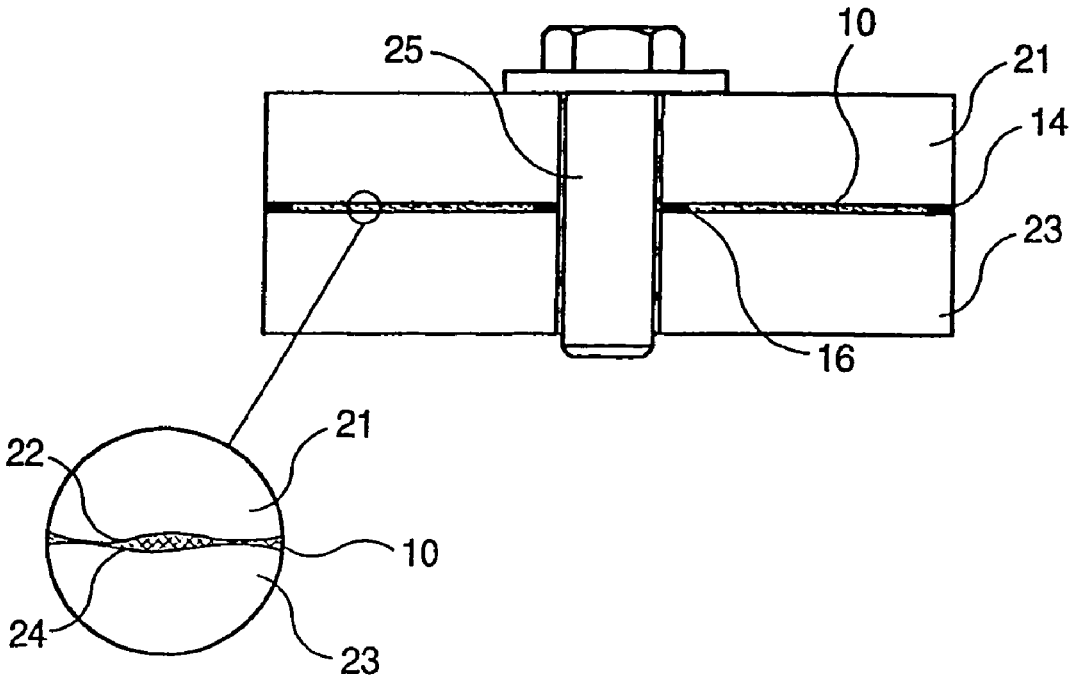

The purposes, objects and characteristics of the invention will become more apparent from the following description when taken in conjunction with the accompanying drawings in which:

FIG. 1*a* is a microscopic representation of a cross section of the copper foam, FIG. 1*b* represents a copper foam pad according to an embodiment of the invention, FIG. 2*a* represents a cross section of the electrical connection according to the invention before tightening, FIG. 2*b* represents a cross section of the electrical connection according to the invention.

With reference to FIG. 1, the conductive insert used in the device according to the invention is a metallic foam 10 preferably manufactured according to the method described in patent application WO 02/059396, on the understanding that the device according to the invention is not limited to metallic foams obtained by the process described in this document. The metallic foam is preferably a copper foam. It has a honeycomb structure and its physical properties are primarily high porosity and deformability and low density in the order of 400 g/m$^2$. In comparison, the density of a sheet of copper of the same thickness is roughly 15 kg/m$^2$.

According to FIG. 1*a* which provides a microscopic and schematic, although open-ended illustration of a cross section of a copper foam pad 10 according to the invention, the honeycomb structure of the copper foam is such that it consists primarily of empty space. Thereby, it's surface features a multitude of contact points 11, measuring roughly one micron in size, offering up to 30 points per mm$^2$. The copper foam is roughly 2 mm thick.

According to one of the embodiments of the invention, this copper foam forming the conductive insert according to the invention is cut to the size of the contact surface of the electrical connection described in FIG. 2 and features an opening 18 so that the clamping bolt can be inserted through it. The copper foam, cut out in this manner, features two peripheral seals 14 and 16. The peripheral seals 14 and 16 may be made in different ways. They may be impregnated in the foam or a sealing product may be deposited on the periphery. It is also possible to make seals by folding the edges of the foam pad onto itself at least once or by rolling the edges of the pad.

FIGS. 2*a* and 2*b* represent an electrical connection according to the invention. According to FIG. 2*a*, the conductors 21 and 23 are located on either side of the copper foam 10 so that their surfaces 22 and 24 come into contact with the copper foam. As such, the copper foam is an insert between the two conductors of the electrical connection. According to FIG. 2*b*, the electrical connection between the conductors 21 and 23 is made by tight contact owing to a tightening means such as a draw bolt 25 passing through both conductors via an opening provided for this purpose and through the opening 18 in the copper foam 10.

The device according to the invention may be used for a contact within a new electrical connection. In this case, it improves the homogeneity of the current flowing through the contact surface. In an electrical connection represented by the two conductors 21 and 23 in contact with one another, for example, contact is greater near the tightening means or draw bolt 25. As a result, the resistance, and thus the electrical losses of the electrical connection made up of the conductors in contact 21 and 23, is minimal near the tightening means 25 and increases further away. This inhomogeneous distribution of the current promotes an area of higher current concentration and thus an area under increased stress and conducive to faster degradation. The addition of the conductive copper foam insert increases the number of contact points between the two conductors 21 and 23 and thus enables homogenous distribution of the current over the entire contact surface. Owing to this homogenous distribution, there are no areas of current concentration, and thus no areas subject to greater loading and conducive to faster degradation.

The device according to the invention may also be advantageously used for a contact within a downgraded or deformed electrical connection. In the field of electrolytic cells and steel plant furnaces, the conductors and electrical connections are subject to high-intensity currents and high temperatures. Connection wear primarily translates by the deformation of the electrical connections' contact surfaces. Significant electrical losses are experienced as a result which could reach several kW per connection as well as variations in the flowing of current through these contact surfaces. Re-machining of the deformed contact surfaces is no longer required owing to the insertion of the copper foam. Significant improvement is obtained in electrical connections with downgraded and deformed contact surfaces 22 and 24, even when deformations in the order of one millimeter are present. The copper foam's deformability allows all of the foam 10 to follow the downgraded contours of the contact surfaces 22 and 24, as shown in the enlarged portion of FIG. 2*b*, and thus to increase the contact surface and distribute the pressure exerted by the tightening means 25. Furthermore, the points 11 on the surface of the copper foam multiply the number of contact points. This results in an improvement in the conducting path conditions by reducing electrical losses. In addition, the points 11 located on the surface of the copper foam also pierce the layers of oxide that appear on the surface of metals and thus conductors 21 and 23, such as copper oxide or alumina in the case of aluminum. These layers have an insulating effect and act as resistors and thus induce electrical losses. As such, the device according to the invention enables the electrical conductance of a worn connection to be improved and even without prior cleaning.

The peripheral seal 14 and 16 helps reduce the amount of external damaging agents that penetrate the connection by creating a hermetic barrier along the periphery of the connection. Furthermore, and particularly in the case of chlorine/caustic soda electrolysis cells, the damaging agents are generally liquids such as soda or wash-water or any other water-borne polluting product.

The copper foam can be improved by depositing a product that improves thermal transfer or electrical conductivity. As such, the use of a silver-plated copper foam as a conductive insert improves the efficiency of the device according to the invention. Indeed, the potential drop of a 1 $dm^2$ connection formed by two copper conductors is in the order of 50 mV for a 5,000 A current. With copper foam, the potential drop decreases to 26 mV and with a silver-plated copper foam, the potential drop is just 5 mV for temperature and pressure conditions that are identical in all three cases. The silver is deposited on the copper foam by a traditional electrochemical process or under vacuum.

The use of a conductive insert comprised of silver foam is also possible without deviating from the scope of the invention.

The device according to the invention is even more advantageous in that it is increasingly efficient as the temperature increases. The potential drop of a 1 $dm^2$ connection using the device according to the invention with a silver-plated copper foam is in the order of a few mV for a current of 5,000 A at 300° C. This particularity is due to the fact that the points 11 of the metallic foam (copper foam, silver-plated copper foam or silver foam) weld together with the conductors 21 and 23 with which they are in contact as the temperature increases.

While metallic foam is preferably used in the implementation of the invention, any other conductive foam comprised of one or more materials could be used.

The device according to the invention presents other numerous advantages. Its implementation is fast, easy and clean. It is particularly advantageous for improving the conductance of copper/copper electrical connections as well as connections between two different electrical conductors such as aluminum/copper, steel/aluminum or steel/copper pairs.

By reducing electrical losses that it induces, the device according to the invention slows down surface condition degradation of electrical connections subjected to high-intensity currents.

The economic advantages of this device are the cost reductions resulting from the decrease in electrical losses and reduced maintenance and servicing. Furthermore, these advantages fall within the scope of an energy savings policy dictated by environmental standards.

The copper foam according to the invention can also be used to improve the thermal contact conductance and thus avoid thermal losses due to heat transfer from one material to another.

In addition, other applications are foreseeable and applicable to electrical connections and to the thermal transfer of electrical components such as diodes, thyristors, etc., as well as for improving the crimping of lugs on aluminum conductors in the automotive sector. As a result, the use of the invention may be applied to low-intensity electrical connections.

The invention claimed is:

1. A contact device for improving the conductance of an electrical connection consisting of two connectors in contact with one another comprising a conductive insert placed between the two contact surfaces of the two conductors of said connection, said conductive insert comprising an electrically conductive foam, with high deformability and porosity in order to reduce the resistance of the connection, wherein said electrically conductive foam comprises a honeycomb structure which consists essentially of silver, and wherein said electrical connection is adapted to conduct current greater than 1,000 A, wherein conductive insert includes at least a peripheral seal creating a hermetic barrier against external damaging agents along a periphery of said conductive insert.

2. The device according to claim 1 in which said conductive insert is placed between said conductors whose contact surfaces are degraded.

3. The device according to claim 1, in which said peripheral seal is made by depositing an elastomer sealing product along the periphery of said conductive insert.

4. The device according to claim 1, in which said peripheral seal is made by at least a fold on an edge of said conductive insert.

5. An electrical connection comprising two connectors, each having a contact surface, a contact device comprising a conductive insert placed between and in contact with the contact surfaces of the two conductors, said conductive insert comprising an electrically conductive foam with high deformability and porosity, wherein said electrically conductive foam comprises a honeycomb structure which consists essentially of silver, and wherein said electrical connection is adapted to conduct an electrical current greater than 1,000 A, wherein conductive insert includes at least a peripheral seal creating a hermetic barrier against external damaging agents along a periphery of said conductive insert.

* * * * *